US009751678B2

(12) United States Patent
Macler

(10) Patent No.: US 9,751,678 B2
(45) Date of Patent: Sep. 5, 2017

(54) RIBBED WATER SPIKE

(75) Inventor: Jeffrey E. Macler, Tecumseh, MO (US)

(73) Assignee: International Packaging Innovations, LLC, St. Louis, MO (US)

( * ) Notice: Subject to any disclaimer, the term of this patent is extended or adjusted under 35 U.S.C. 154(b) by 814 days.

(21) Appl. No.: 12/755,251

(22) Filed: Apr. 6, 2010

(65) Prior Publication Data

US 2011/0031273 A1 Feb. 10, 2011

Related U.S. Application Data

(60) Provisional application No. 61/167,044, filed on Apr. 6, 2009.

(51) Int. Cl.

| | |
|---|---|
| ***B67D 1/00*** | (2006.01) |
| ***B65D 77/06*** | (2006.01) |
| ***B65D 25/48*** | (2006.01) |
| ***B65D 75/58*** | (2006.01) |
| ***B67B 7/00*** | (2006.01) |

(52) U.S. Cl.

CPC ..... *B65D 77/068* (2013.01); *B65D 25/48* (2013.01); *B65D 75/5877* (2013.01); *B67B 7/24* (2013.01)

(58) Field of Classification Search

CPC .... B67D 1/00; B67B 7/26; B67B 7/28; B65D 77/068; B65D 25/48; B65D 75/5877

USPC ..... 222/80–91, 5, 106, 105; 220/583, 267, 220/277, 278; D7/397–400

See application file for complete search history.

(56) References Cited

U.S. PATENT DOCUMENTS

| | | | | | |
|---|---|---|---|---|---|
| 1,971,284 | A | * | 8/1934 | Stockman | 222/90 |
| 2,925,199 | A | * | 2/1960 | Brookshier | 222/91 |
| 3,278,083 | A | * | 10/1966 | Serafini | 222/91 |
| 3,343,724 | A | * | 9/1967 | Malpas | 222/90 |
| 3,460,715 | A | * | 8/1969 | Jones et al. | 222/90 |
| 3,768,698 | A | * | 10/1973 | Corty et al. | 222/91 |
| 3,927,803 | A | * | 12/1975 | Weber | 222/91 |
| 3,973,698 | A | * | 8/1976 | Kato | 222/91 |
| 4,325,496 | A | * | 4/1982 | Malpas | 222/83 |
| 4,542,530 | A | | 9/1985 | Thomas et al. | |
| 4,603,793 | A | * | 8/1986 | Stern | 222/105 |
| D295,138 | S | * | 4/1988 | Hyde | D7/398 |
| 4,826,500 | A | * | 5/1989 | Rautsola | 604/411 |
| 5,052,614 | A | * | 10/1991 | Xuan | 229/103.1 |
| 5,325,995 | A | * | 7/1994 | Harrison et al. | 222/81 |
| 5,647,511 | A | | 7/1997 | Bond | |
| 6,227,410 | B1 | * | 5/2001 | Stern | 222/1 |
| 6,932,247 | B2 | | 8/2005 | Clerget | |

(Continued)

FOREIGN PATENT DOCUMENTS

EP 1676784 A1 7/2006

OTHER PUBLICATIONS

International Search Report, International Patent Application No. PCT/US2010/030115, mailed Oct. 20, 2011, 7 pages.

(Continued)

*Primary Examiner* — Lien Ngo

(74) *Attorney, Agent, or Firm* — Lewis Rice LLC

(57) ABSTRACT

A ribbed spike for use with dispensing a fluid, such a water, from a bag. The spike includes a plurality of ribs or undulations on its outer surface which can improve connection strength to a bag of fluid. Systems and methods for using such a spike in the dispensing of fluid in a variety of situations are also provided.

5 Claims, 9 Drawing Sheets

(56) References Cited

U.S. PATENT DOCUMENTS

| | | | | |
|---|---|---|---|---|
| 7,165,700 | B2 * | 1/2007 | Macler et al. | 222/83 |
| 7,188,749 | B2 * | 3/2007 | Miller et al. | 222/1 |
| 7,980,424 | B2 * | 7/2011 | Johnson | 222/83 |
| 8,550,308 | B2 * | 10/2013 | Py et al. | 222/207 |
| 2005/0121464 | A1 | 6/2005 | Miller et al. | |
| 2008/0142543 | A1 | 6/2008 | Jones | |

OTHER PUBLICATIONS

Examination Report, European Patent Application No. 10 762 312.6, issued on Jan. 21, 2015, 5 pages.

* cited by examiner

RIBBED WATER SPIKE

CROSS REFERENCE TO RELATED APPLICATION(S)

This Application claims the benefit of U.S. Provisional Patent Application Ser. No. 61/167,044, filed Apr. 6, 2009, the entire disclosure of which is herein incorporated by reference.

BACKGROUND OF THE INVENTION

1. Field of the Invention

This disclosure relates to the field of systems for dispensing of fluids. In particular, to the field of fluid dispensing systems wherein a bagged fluid, such as water, is dispensed via a ribbed water spike.

2. Description of Related Art

Liquid storage vessels such as jugs or pitchers are essentially ubiquitous in society and have been around in a general form for centuries. A liquid storage vessel generally serves two purposes. It serves to contain a liquid so that the liquid does not spill, evaporate, or be soaked up by other objects from which it cannot easily be removed, and it serves as a way to dispense the liquid to users to drink, wash with, or otherwise utilize.

As technology has improved, the jug has become lighter, easier to use and store, and easier to handle and dispense from. At the same time, the general concept remains relatively unchanged. Most traditional vessels are shaped so the liquid is contained by gravity in a portion of the device. When the device is tilted or upended, the liquid is placed into contact with a hole which allows it to be dispensed to the user. While this is a universally used design, it is not always the best choice from a storage point of view.

These traditional liquid storage and transportation vessels are utilized in a number of different settings and circumstances. For example, in emergency situations caused by natural disasters, as well as in developing countries which lack a reliable potable water infrastructure, liquid storage and transportation vessels are utilized to provide and transport water to at risk populations. Outside of emergency situations, liquid storage and transportation vessels are also common technologies utilized by individuals numerous times over the course of a day. For example, in the modern household it is common for liquids to be stored in the refrigerator in order to have constant access to liquids at a cooled temperature; a temperature most individuals prefer for human consumption. As such, self-contained fluid dispensers are commonly used in the modern refrigerator or kitchen. Stand alone liquid storage vessels are also commonly found in today's modern society. In fact, state and federal regulations mandate that many workplace environments contain office water coolers. Yet another common use of liquid transportation and storage vessels is at athletic games or during other outdoor activities. These portable water coolers provide a communally accessible supply of water for individuals participating in these activities.

As noted previously, in the modern household, liquids to be consumed are most often stored in a refrigerator. This allows for the liquids to be cold which often provides improved taste characteristics as well as making the beverage more refreshing to consume and helping to preserve some beverages for a longer time. However, the design of most storage vessels is often wasteful when placed in a refrigerator and also does not always provide for as sanitary storage as would be desired.

To make such a vessel easy to pour from (upend), most vessels used currently are relatively narrow and tall. In order to store such vessels of liquid in the refrigerator so as to allow them to be dispensed cool, a user will generally have to have a large upright space available in the refrigerator. This storage space is often limited to a single shelf of the refrigerator (often the top shelf) which can make storing the jugs and using the jugs difficult. Further, to be able to pour from these vessels, they often have handles which stick outwards from them and increase the effective footprint of the vessel, therefore requiring more shelf space than is desirable.

To try and deal with this problem, many individuals now use various liquid dispensers in their refrigerator. These are devices designed to sit on a refrigerator shelf generally having a dispensing valve on the lower surface therefore, which hangs over a shelf in the refrigerator and allows for dispensing of fluid from the bottom of the device. These liquid dispensers have the advantage of allowing "squarer" storage of fluid in the refrigerator and in the net taking up less space and being able to more easily store. In particular, liquid dispensers are often shaped so as to have a larger footprint, but a significantly decreased height allowing them to sit on shelves more easily. Further, because liquid dispensers can be more rectangular and often do not need a pouring handle, they can more efficiently fill space.

Liquid dispensers, however, have the problem of being damaged by fluids within them. The liquid dispensers generally are hollow vessels which enclose the fluid and prevent it from escaping. They also will usually include an attached spigot or other dispensing device to allow the fluid to be dispensed in a controlled manner to a user. Fluid is generally added from above by removing the top panel of, or opening an access point in, the vessel and placing the fluid directly against the interior walls of the vessel and inside the hollow interior. A top or a cap may then be used to prevent introduction of outside substances into the fluid.

In this arrangement, the inside surfaces of the dispenser can become contaminated with particles of the fluid or items suspended in the fluid. An excellent example is when a powdered soft drink mix is dispensed from the vessel. Powdered soft drink mixes come in a variety of forms and under a variety of trade names but generally are designed to add concentrated flavoring and/or coloring to water to improve taste or appearance. Many also include concentrated vitamins, minerals or other enhancers to improve the nutrition from drinking the soft drink mix over drinking regular water. Many also include granulated sugar. These soft drink mixes are added to water where they dissolve or are suspended in the water.

Many vessels used to store liquids are constructed of plastics to decrease weight, decrease production cost, and make the vessels more rugged and survivable. When a soft drink mix (in solution) is placed against these materials, the vessel's surfaces can absorb or be coated by some of the powdered solution suspended in the water which adheres to the surface as opposed to remaining suspended in solution. Further, taste and odors from the soft drink mix can permeate the vessel. This "contamination" can cause problems to the vessel. For one, contamination can change the taste of other fluids dispensed from the vessel in an unpleasant fashion. For instance, a grape flavoring contaminating a vessel can be partially transferred to later added ice tea flavoring, creating an unpleasant combination. This can be particularly true with beverages having a particularly strong taste such as coffee. Sometimes, a strongly flavored beverage can so impregnate the walls that its scent or taste cannot be removed even with a thorough cleaning. This can prevent a vessel from being reused with other flavors of fluid, and can even require the vessel's destruction if it cannot be used anymore due to the flavor impregnation. Contamination can also lead to the introduction or growth of microorganisms which can make the vessel unsanitary for future use regardless of the impact on flavor. Still further, cleaning agents used to clean the vessel also can impart tastes and odors that can flavor a later dispensed liquid.

Additionally, because the fluid is placed directly within the hollow interior of the vessel, various impurities can also be introduced to the fluid. For instance, if a lid is not provided to the vessel, dust, other particulates, or microorganisms may be introduced into the fluid over time. Further, if the vessel remains empty and is then filled, dust or other particulates may have been introduced to the empty vessel which are then suspended in the fluid when it is added and may be dispensed.

Further, because the vessel must be "watertight" in order to prevent leakage of the fluid being dispensed, market distribution and storage of empty dispensers, or dispensers sold with fluid therein, will often take up significant space inefficiently, as such dispensers often cannot collapse and are not sized and shaped to pack efficiently for travel. Therefore, a user may often have wasted space taken up by the dispenser when it is not in use because the dispenser cannot be broken down or collapsed. Further, because it is generally a fairly costly device, users are reluctant to discard an unused dispenser unless they are certain they have no further need for it. Thus, there are numerous problems in the art with traditionally utilized refrigerator liquid storage vessels.

As noted previously, outside of the home environment, it is common for portable fluid storage devices and dispensers to be utilized in many different types of human activities. For example, fluid storage devices are often used to transport beverages, particularly for human consumption, to locations where other means of obtaining beverages would be impossible or, at least, inconvenient. Commonly such a container will be filled with fluid and taken along in instances such as when a person travels for recreation, including going to an undeveloped area to hike, to a park for a picnic, to the beach, or to participate in or observe an athletic event. Principally, the containers are used to carry fluid for drinking to decrease the danger of dehydration and heat exhaustion and related injury when outdoors, and also merely for comfort when one becomes thirsty. Quite often the fluid storage device is designed to embody thermal insulating properties for maintaining the temperature of the fluid significantly above or below the ambient temperature.

In addition to personal uses such as those mentioned above, portable insulating fluid containers may have public uses. They may be used to sanitarily dispense beverages in food service establishments or the like, and therefore regularly are seen in concession stands, buffet lines, or similar types of locations where storage and dispensing of prepared drinks is desirable but where more permanent structures are not usable. Such containers are regularly filled with water and other fluids or drinks such as coffee, tea, soft drinks, fruit juices, or the like. Further, portable insulating fluid containers are not limited to carrying beverages but may also be used to transport non-potable fluids.

The portable insulating fluid containers described herein for transportable use include those generally referred to by use of the terms "water cooler" or simply "cooler," "water jug," and "Thermos™." For the purposes of this disclosure, the term "portable water cooler" is chosen since it is fairly descriptive of the device being discussed. A portable water cooler will generally be transportable by one or more persons without the assistance of machines, although some embodiments will require a machine to lift or carry (for instance the water cooler may be mounted on a large trailer). A portable water cooler will generally not be a system designed for purposeful use only in a single location, but a portable water cooler may be "built in" and adapted for single-location use. A portable water cooler generally serves as a storage container for the fluid there inside. That is, the fluid generally is not placed in the cooler from an external storage tank for the purpose of cooling or heating prior to dispensing. Also, a portable water cooler generally includes an integral spigot or valve for the dispensing of the liquid contained therein to a drinking container such as a cup or directly to a user's mouth. It is generally not intended that the fluid in the portable water cooler be dispensed to a storage reservoir from which it is then dispensed. The water cooler is generally constructed, in part, of an insulative material, or has a built-in cooling or heating system to control the temperature of its contents. Rubbermaid Corporation makes a variety of such portable water coolers. Devices such as the military's "water buffaloes" also fall within the scope of devices herein termed portable water coolers. A majority of portable water coolers used for fluid transport and dispensing are constructed with materials such as stainless steel, glass, and plastics, or some combination thereof, that give the portable water coolers a rigid form.

While there are many types of portable water coolers available in the market, many suffer from similar problems. A portable water cooler is generally in the shape of a hollow upright box or cylinder which encloses the fluid and prevents it from escaping the container. Fluid is generally added from above by removing the top panel of, or opening an access point in, the cooler and placing the fluid directly against the interior walls of the cooler inside the hollow interior. The lid or a cap is then replaced. In some portable water coolers, the lid seals the fluid inside the container, while in others the lid may partially seal the container but the fluid can knock the lid loose and escape if the container is tipped from upright. Fluid is dispensed through the use of a spigot or valve often located towards the bottom of the fluid holding area of the cooler. The spigot is generally a manually operated structure having a moveable valve. The valve is placed in a hole which extends through the outer structure of the portable water cooler connecting the hollow interior to the external world. When the valve is opened, the weight of the fluid in the portable water cooler forces fluid at the bottom of the cooler through the hole, where it is generally dispensed in a stream to a user generally holding a smaller beverage container thereunder.

Alternatively, smaller water coolers may include the spigot or valve in a different arrangement to allow a user to directly drink from the portable water cooler. These may include straws, spigots, or even just holes where fluid is allowed to flow from the hollow interior of the portable water cooler to the user. Some of these devices require the user to open them prior to drinking (generally to prevent spills), while others may place the hole on the top of the container so that the user has to tip the portable water cooler (generally into their mouth) to get the fluid out. In almost all cases, the fluid is dispensed under the force of gravity by simply allowing the fluid to pass through a hole in the outer structure of the portable water cooler when the fluid is being dispensed. The walls, base, and lid of the cooler are generally constructed of insulative materials (often various foamed resins) to provide that the temperature of the enclosed fluid is better maintained over time when that temperature is different from the ambient temperature.

While these portable water coolers have many beneficial uses, they also have clear disadvantages, including susceptibility to contamination from various sources. For instance, while the portable water cooler is being filled, dust or particulates may be introduced into the fluid as the fluid is added to the cooler. Further, in many coolers, the lid is not necessarily placed on the cooler when it is in use. If the cooler is undergoing particularly heavy use, the lid may be left off to allow rapid refilling. This can allow the introduction of foreign matter. Because the fluid is in direct contact with the sides of the portable water cooler, if the cooler is not regularly cleaned (which may not always be possible), buildup of contaminants can result in the growth of biofilms or other microorganisms which could potentially be toxic to those drinking the fluid.

When the coolers are used to dispense fluids, the inside surfaces of the cooler can become contaminated with particles of the fluid or items suspended in the fluid. An example of such contamination of the container occurs when a dissolved powdered soft drink mix is held within the container. Powdered soft drink mixes come in a variety of forms and under a variety of trade names but generally are designed to add concentrated flavoring and/or coloring to water to improve taste or appearance. Many soft drink mixes also include concentrated vitamins, minerals or other enhancers to improve the nutritional content of the soft drink mix as compared with plain water. Many soft drink mixes also include granulated sugar to improve taste. These soft drink mixes are added to water in which they dissolve or are suspended. When a soft drink and water mixture is placed in contact with the interior walls of the container these wall surfaces can adsorb fluid components. Due to such interaction between the fluid and the container or due to other causes, tastes and odors from the soft drink mix can permeate the fluid container. This contamination can cause a significant negative impact on the taste of beverages later dispensed from the container. In a specific instance a grape flavoring contaminating the portable fluid container can be partially transferred to later added ice tea, creating an unpleasant grape-tea combination.

Such container contamination can be particularly problematic when caused by beverages having strong tastes and odors such as coffee. Sometimes, a strongly flavored beverage can so impregnate the container walls, that its scent or taste cannot be removed even with a thorough cleaning. This can prevent a portable fluid container from being reused with other flavors of fluids, and can even require the container's destruction if the flavor interference is too great for a particular use. Absorption or other causes of contamination can also make the container unsanitary for future use regardless of flavor.

Taken the above together, similar to the storage vessels used in refrigerators, there are numerous problems known to those of skill in the art which are associated with portable water coolers.

As touched upon earlier, the office cooler—along with the refrigeration storage vessel and the portable water cooler—is a common liquid transportation vessel in modern society. The conventional domestic fluid dispensers used for this purpose are usually free standing devices which dispense sterilized or mineral water from large rigid water bottles. The rigid water bottles have a large body portion and a narrow neck portion having a mouth opening, and are coupled to the water dispenser by inverting the bottle and positioning the mouth of the bottle in the chamber of the water dispenser. Air, introduced into the water bottle through the mouth, allows water to be dispensed from the inverted bottle until the water level in the chamber reaches the mouth of the bottle. Since the water bottle is rigid, once the water level in the chamber reaches the mouth of the bottle no more air can enter the bottle, so water remaining in the inverted bottle is retained in the bottle due to the difference between the air pressure external to the inverted bottle and the air pressure inside the bottle. Water is then dispensed from the chamber through a conduit attached to a valve at the opposite end from the chamber. When the level of water in the chamber falls below the mouth of the water bottle, air enters the water bottle, allowing water to flow from the bottle until the water level in the chamber again reaches the mouth of the bottle.

Although conventional domestic water dispensers are widely used, they are deficient in a number of respects. First, water bottles used in the conventional domestic water dispenser usually contain a large quantity of sterilized water, typically on the order of about 5 gallons. Due to the weight and size of a bottle holding that amount of water, it is often difficult to invert and properly locate the mouth of the bottle in the chamber without spilling a quantity of the water.

Second, to prevent water from continuously flowing from the water bottle while the water bottle is inverted, the water bottles used with such water dispensers are fabricated from a thick, rigid, plastic material that can hold a vacuum without collapsing. Due to their cost, the water bottles are usually resterilized and reused after an initial use. As a result, the cost of shipping the empty water bottle back to the supplier for sterilization and reuse are adsorbed by the consumer through increased water costs.

Third, in order for the mouth of the water bottle to be positioned in the chamber of the cooler, the water bottles must have a neck, as described above. The presence of the neck, however, increases the difficulty in sterilizing the water bottles, since the neck may limit the ability of the sterilizing agents to reach all the interior parts of the bottle, even when large quantities of sterilizing agents are used. While the use of heat sterilization may overcome this problem to some extent, it is generally not possible to use heat sterilization on plastic bottles. Although sterilization using ultraviolet light is possible, ultraviolet light sterilization may lead to an incomplete result. Particularly troublesome, once the bottle is inverted into the fluid dispenser, the outside of the neck of the bottle contacts the fluid, and it is very difficult to maintain sterility on this area of the bottle.

Fourth, with the necessity of sterilizing the water bottles after each use, over time the rigid plastic water bottles may develop cracks or holes. If such failures occur while the water bottle is inverted in the water dispenser, air will enter the water bottle and allow water to flow uncontrollably from the mouth of the water bottle, allowing the chamber to eventually overflow. This water overflow can expose the purchaser's premises to the risk of water damage.

In addition to an application in modern society as refrigerator coolers, portable water coolers and domestic, or "office," coolers, liquid transportation vessels also have utility in the developing world in areas where there is not a reliable potable water infrastructure. Further, in addition to the developing world and other areas where access to potable water and sanitation are significant issues, liquid transportation and storage vessels are also utilized, in both the developing and the westernized world, during health scares and in the wake of natural disasters. The liquid transportation vessels utilized in these situations are collectively referred to as "emergency" or "disaster" water transportation devices.

To combat the problems caused by lack of access to potable water, lack of resources and contamination, both in developing countries without adequate infrastructures and in westernized countries during health scares and in the wake of natural disasters, many international aid organizations and emergency relief services have developed water storage containers and sanitation systems to supply at-risk populations with sanitized water.

Present devices include emergency water filters for the removal of biological pathogens from the water, water drums (large containers, 30 to 50 gallons, made of polyethylene food grade plastic used to transport water to at-risk areas), emergency water rations in foil pouches, germicidal treatment tablets for emergency disinfection of drinking water, water bladders for use in a bathtub, transportable plastic water jugs and inflatable water bags.

The main problems with the present devices used to supply potable water to emergency disaster areas and developing countries in need of sanitary water are four-fold: high cost, difficulty in transporting, sanitation, and ease of use.

Emergency water filtration systems and germicidal tablets that sanitize a large enough quantity of water for a large population can be expensive. Further, use can be complicated and failure to use such systems properly can result in re-contamination of water supplies. Accordingly, such systems are often not economically or practically reasonable.

Water drums and plastic water jugs can be expensive, hard to transport and susceptible to contamination during use. These containers are usually made of polyethylene food grade plastic, and are in a 30 to 50 gallon size. Transport of such containers to the at-risk area is usually by truck or airline freighter. Once filled, the containers are heavy and burdensome to load and transport. The container's rigid shape limits the number of containers that can be transported at one time. Further, the added weight of the plastic container results in a higher price of transport, i.e., more fuel is needed to get the containers to their desired location. Further, in use, the lid of the drum is opened to allow access to the water inside, or a twist cap/opening system can be utilized. The wide opening of such access systems can lead to a contamination of the water supply in the drum or plastic container as it is utilized by a number of different people in an emergency situation.

Further, as the wide opening is open to the outside ambient air, the water supply housed in the jug or drum is further susceptible to contamination by airborne particulate.

Another major problem with plastic bottles and drums is that they must be washed and sanitized between every use. This adds to the cost of such water storage systems and is a particular problem in the developing world where water is already scarce, and the drums and jugs must be re-transported to a washing station for further sanitation after use.

The present emergency water rations in foil pouches and inflatable water bags, while easier to transport and lower in cost, have sanitation and ease of use concerns. Some bags simply need to be "cut open" to access the water. Such designs are easily contaminable and not easily stored after opening. In other bagged systems that use a pump, the initial puncturing of the bag can be difficult, often resulting in holes in both sides of the bag or contamination of the water source from repeated puncturing attempts. In addition, after the initial puncturing, these devices can leak around the opening to the dispensing device and the plastic bag. Further, the foil bags are not usually recyclable, adding to waste concerns in disaster and developing areas. Lastly, although some inflatable water bags may be reused, they must be washed and sanitized between each use, raising the same problems of cost and transport that were previously mentioned when discussing sanitation of the plastic bottles and drums between use.

As illustrated in these brief descriptions of liquid transportation and storage vessels in four main areas—refrigeration coolers, portable water coolers, domestic "office" coolers, and fluid transportation systems utilized in emergency situations—there are several key problems with currently utilized fluid transportation and storage systems that are common, no matter the specific circumstances of use. Notably, the aforementioned fluid transportation and storage systems generally share five common problems: interior contamination from fluids; fluid contamination from outside sources; sanitation/sterilization; weight and size; and high cost of manufacture. The fluid dispensing system of the present disclosure, wherein a bagged fluid is dispensed via a ribbed spike, addresses and minimizes each of these problems commonly encountered in currently utilized liquid transportation and storage modalities in all areas of use.

To combat these problems, the refrigerator cooler, the portable water cooler, the domestic "office" coolers and the fluid transportation systems utilized in emergency situations can all be utilized with spiking bagged water systems, such as, but not limited to, those disclosed in U.S. patent App. Ser. No. 12/533,914, U.S. Pat. No. 7,188,749, U.S. Pat. No. 7,165,700, and U.S. Pat. No. 7,331,487, the entire disclosures of which are hereby incorporated by reference. These spiked bagged water systems all utilize bagged water and a spiking mechanism to access the bagged water in a dispensable, sanitary format.

Generally, in these systems, the bag of water is forced onto a hollow shaft that has a spiking device either by gravity or by additional human force. This force causes the spiking device to break through the outer wall of the bag, allowing the spiking device access to the fluid housed therein. Then the fluid house in the bag flows into the hollow spiking device via gravity or a mechanical force, and is dispensed therefrom. The ribbed spiked disclosed herein is a type of spiking mechanism for use in these bagged water systems that allows for greater stability and security.

SUMMARY OF THE INVENTION

Due to these and other problems in the art, disclosed herein is a ribbed spiked water dispensing device comprised of a shaft with at least one rib on its exterior surface and a spiked tip with openings, wherein said ribbed spiked water dispensing device makes it harder for a water dispensing device to be removed once the device is inserted into a bag of water.

There is described herein, among other things, A spike for use in dispensing a liquid from a bag, the spike comprising: a hollow shaft comprising two ends and an elongated body therebetweeen, said body including an outer surface; a tip arranged at a first of said two ends, said tip being capable of penetrating the outer surface of a bag containing fluid; at least one and generally a plurality of ribs, each of said ribs being arranged on an external surface of said body so as to circumscribe said body at a point between said two ends.

In an embodiment of the spike said body is generally cylindrical.

In an embodiment of the spike said tip is generally conical and may comprises at least one opening.

In an embodiment the spike further comprises a spigot at a second of said two ends.

There is also described herein a liquid dispensing system, the system comprising: a spike, the spike comprising: a hollow shaft comprising two ends and an elongated body therebetweeen, said body including an outer surface; a tip including at least one opening arranged at a first of said two ends; at least one rib, each of said at least one rib being arranged on an external surface of said body so as to circumscribe said body at a point between said two ends; and a flexible bag comprising: an outer wall; and a fluid contained therein said outer wall; wherein said spike is positioned through said outer wall such that said tip and at least one of said at least one rib is within said fluid.

There is also described herein a method for dispensing liquid, the method comprising: providing a spike, the spike comprising: a hollow shaft comprising two ends and an elongated body therebetweeen, said body including an outer surface; a tip including at least one opening arranged at a first of said two ends; a spigot arranged at a second of said two ends; and a plurality of ribs, each of said ribs being arranged on an external surface of said body so as to circumscribe said body at a point between said two ends; and providing a flexible bag comprising: an outer wall; and a fluid contained therein said outer wall; spiking said bag by forcing said spike through said outer wall such that said tip and at least one of said plurality of ribs is within said fluid; and dispensing said fluid by opening said spigot.

DESCRIPTION OF THE PREFERRED EMBODIMENT(S)

Figure 1A:
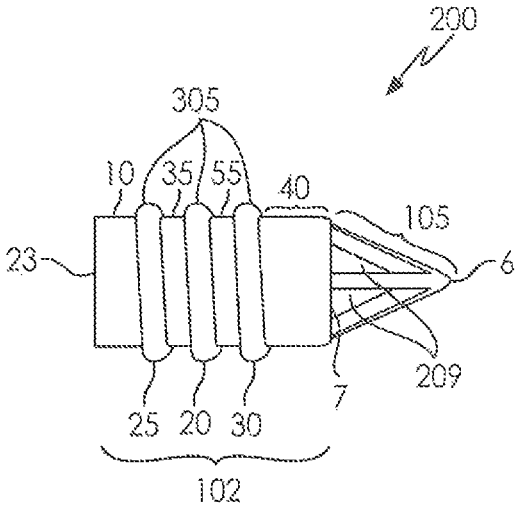
FIG. 1 provides several side views of an embodiment of the ribbed water spike.

With reference to FIGS. 1-17, a ribbed spiked water dispensing device will be described according to several embodiments of the present invention.

Turning now to FIG. 1, a ribbed spiked water dispensing device (200), in accordance with one embodiment of the invention, is shown. Generally made of plastic, the ribbed spiked fluid dispensing device (200) pictured in FIG. 1 is generally comprised of four main elements: a shaft (102), a spiked tip (105), openings in the spiked tip (209), and one or more ribs (305).

Figure 1B:
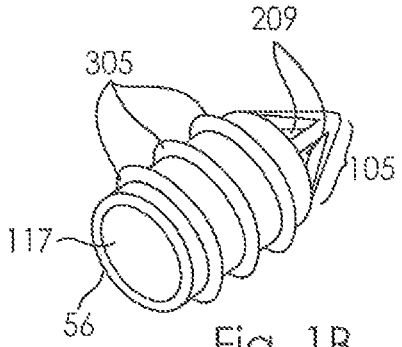
Figure 1C:
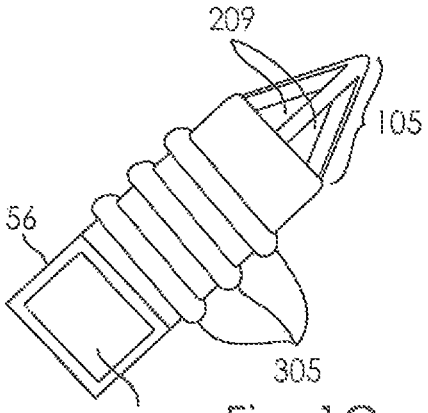

The shaft (102) of the ribbed spiked fluid dispensing device (200) of FIGS. 1A, 1B and 1C has an internal volume (117) and an exterior shell (56). It is contemplated that the shaft (102) of the fluid dispensing device (200) can take on a number of different shapes. As seen in FIGS. 1A and 1B, in one embodiment the shaft (102) is cylindrical in shape; specifically the shaft (102) is a circular cylinder. Generally, any cylindrical shape with an internal volume (117) through which fluid can flow known to those of skill in the art, including elliptic cylinders, parabolic cylinders or hyperbolic cylinders is a contemplated shaft (102) shape. In another embodiment, as shown in FIG. 1C, the shaft (102) is a prism in shape. Generally, any n-sided prism shape with an internal volume (117) through which fluid can flow is contemplated in this disclosure. Similarly, any sized internal volume (117) of the shaft (102) that allows for the fluid to flow through the shaft (102) is contemplated in this disclosure. The shaft (102) of the fluid dispensing device (200) has a fore (23) and an aft (7) end with a length there-between. The length of the shaft (102) can be any length needed such that fluid can easily flow through the internal volume (117), from the aft (7) to the fore (23) end of the shaft (102). The fore (23) end of the shaft (102) will be connected to a spigot, piping, rubber cover or other dispensing device of a fluid pathway known to those of skill in the art. At the aft (7) end of the shaft (102) a spiked tip (105) will be located.

The spiked tip (105) of the ribbed spiked fluid dispensing device (200), as seen in FIG. 1, is generally cone shaped. The base of the cone shaped spiked tip (105) is connected to the aft end (7) of the shaft (102) such that fluid can flow from the internal volume (117) of the spiked tip (105) into the internal volume (117) of the shaft (102). The terminating point (6) of the spiked tip (105) is generally located aft (7) of the shaft (102). While a cone shaped spiked tip (105) is depicted in the Figures, this disclosure contemplates any shaped spiked tip (105), with an internal volume (117) through which fluid can flow, that can easily puncture the exterior film of any fluid filled bag known to those of skill in the art.

The third element of the ribbed spiked fluid dispensing device (200) is the openings in the spiked tip (209). As depicted in FIG. 1, these openings (209) are cut holes in the structure of the spiked tip (105) that allow for access into the interior volume (117) of the spiked tip (105) and the interior volume (117) of the shaft (102). While triangular in shape in the embodiment depicted in FIG. 1, it is contemplated that these openings (209) can take any shape known to those of skill in the art that allows for fluid to flow into the interior volume (117) of the spiked tip (105) and the interior volume (117) of the shaft (102). Furthermore, while four openings (209) are depicted in the spiked tip (105) of FIG. 1, this disclosure contemplates any spiked tip (105) with one or more openings (209).

The fourth element of the ribbed spiked fluid dispensing device (200) are the ribs (305). In one embodiment, as seen in FIG. 1, the ribs (305) are located along the exterior length of the shaft (102) from the fore end (23) of the ribbed spiked fluid dispensing device (200) to the aft end (7) of the shaft (102), adjacent to the spiked tip (105). The ribs (305) are one or more raised undulations in the exterior shell (56) of the shaft (102) of the ribbed spiked fluid dispensing device (200). The ribs (305) of the fluid dispensing device (200) can be seen from different angles in FIGS. 1, 2 and 3. In the Figures, three ribs (305) along the length of the shaft (102) of the ribbed fluid dispensing device (200) are depicted. However, this disclosure contemplates any spiked fluid dispensing device (200) with one or more ribs (305) located along the length of the shaft (102) from the fore end (23) of the shaft (102) to the aft end (7) of the shaft adjacent to the spiked tip (105).

Figure 2:
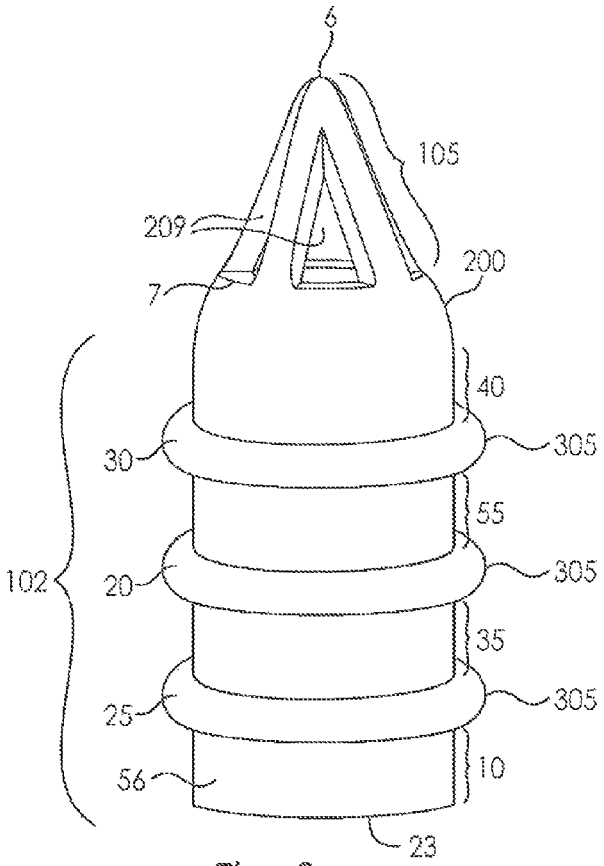
FIG. 2 provides a side view of an embodiment of the ribbed water spike.

As most clearly depicted in FIG. 1A and FIG. 2, in one embodiment, the ribs (305) are equally spaced relative to each other along the length of the shaft (102) of the ribbed fluid dispensing device (200), however, any arrangement or spacing of the ribs (305) along the length of a shaft (102) of a fluid dispensing device (200) that functions to increase resistance, making it harder for an individual to inadvertently remove the ribbed spiked fluid dispensing device (200) from the bag once inserted, is contemplated in this disclosure. For example, in one embodiment, two ribs (305) could be closely spaced together near the fore end (23) of the ribbed spiked fluid dispensing device (200), then there could be a length along the middle of the shaft (102) with no ribs (305) located on its exterior surface (56). Then, there could be located another grouping of two ribs (305) closely spaced together at the aft end (7) of the shaft (102), near the spiked tip (105).

In one embodiment, illustrated in FIG. 1 and FIG. 2, and most easily viewed from the side angle of FIG. 1A, the dimensions of the ribs (305) of the ribbed spiked fluid dispensing device (200) are as follows. In this embodiment, the diameter of the internal volume (117) of the shaft at point A (10), located at the fore-most end (23) of the shaft (102), is 17.5 mm. Points B (35) and C (55), the areas of the shaft between the first rib (25), the second rib (20), and the third rib (30), are also areas of the shaft (102) were the diameter is generally 17.5 mm. In contrast, the diameter of the shaft (102) at the first rib (25), the second rib (20), and the third rib (30) is generally 19.5 mm. Point D (40), the length of the shaft (102) between the third rib (30) and the aft end (7) of the shaft (102) at the spiked tip end (105) is generally 16.5 mm in diameter. Regarding placement along the length of the shaft (102), points B (35) and C (55) are generally 3.0 mm in shaft (102) length. Generally, the first rib (10), the second rib (20), and the third rib (30) are also 3.0 mm in length. These dimensions of the diameter of the shaft (102) at various points along its length, at areas both with and without ribs (305), are only exemplary. Any diameters of the shaft (102) known to those of skill in the art that allow for fluid dispersion through the internal volume (117) of the shaft (102) are contemplated in this disclosure. Further, any dimensions of the raised ribs (305) known to those of skill in the art that allow for the ribs (305) to function as a resistance mechanism that prevents an individual from easily removing the ribbed spiked fluid dispensing device (200) from the bagged fluid after insertion is contemplated in this disclosure. Similarly, any spacing of the ribs (305) along the length of the shaft (102) that allows for the ribs (305) to function as a resistance mechanism that prevents an individual from easily removing the ribbed spiked fluid dispensing device (200) from the bagged fluid after insertion is contemplated in this disclosure.

Figure 3:
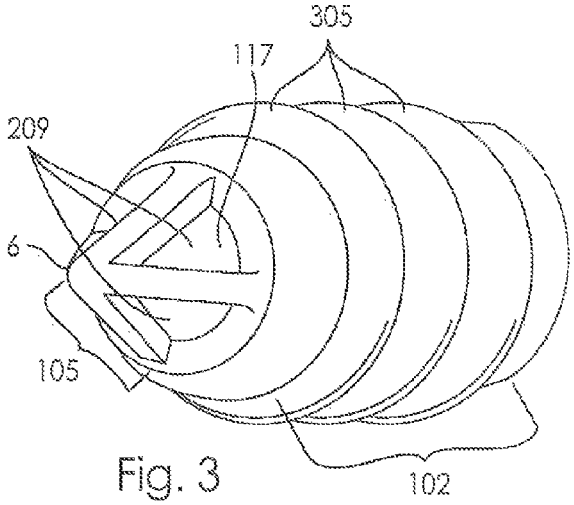
FIG. 3 provides another side view of an embodiment of the ribbed water spike.

While FIGS. 1-3 shows a ribbed spiked fluid dispensing device (200) made of plastic, this application contemplates ribbed spiked fluid dispensing devices (200) made of a plurality of materials known to those skilled in the art. In one embodiment of the ribbed spiked fluid dispensing device (200), the ribs (305) are molded as part of the ribbed spiked fluid dispensing device (200) and, as such, are made of plastic or a plurality of other materials known to those of skill in the art. However, it is contemplated that the ribs (305) can be made of a different material than that of the ribbed spiked fluid dispensing device (200). In another embodiment of the ribbed spiked fluid dispensing device (200), the ribs (305) are a separate structure from the fluid dispensing device (200). In this embodiment, the ribs (305) are a sleeve generally made of rubber, although any other material known to those of skill in the art is contemplated. In this embodiment, the sleeve is positioned on the outside of the shaft (102) of the fluid dispensing device (200) such that the ribs (305) of the sleeve align properly along the length of the shaft (102) of the fluid dispensing device (200) from the fore end (23) of the shaft (102) of the fluid dispensing device (200) to the aft end (7) near the spiked tip (105).

The ribbed spiked fluid dispensing device (200) shown in FIGS. 1-3 is used in conjunction with a bagged fluid to create a system for dispensing fluids. In one embodiment, this bagged fluid is a hermetically sealed bag of water (205). While water is the preferred substance transported by the bag (205), this application contemplates any liquid suitable for human consumption. In a preferred embodiment, the bag (205) is made of a plastic material such as an organic polymer sheet material that is heat sealed to create a hermetic seal. It is preferable that the plastic material is flexible and pliable such that it does not impart a rigid shape to the fluid. However, any type of bag and sealing mechanism used for transport of food or water now, or in the future, known to those skilled in the art is contemplated. The bag of water (205) may also be of any suitable construction. Preferably the bag of water (205) comprises a single-layer film wall. In an alternate embodiment, a bag (205) may be constructed with several plies of material or a set of bags placed within one another. Such a multi-layer bag system may include what is commonly referred to in the art as a secondary containment or an overwrap. For the embodiment of the bag water (205) that has several layers, one or more of the layers must be removed prior to puncturing the device with the ribbed spiked water dispensing device (200) (a process which will be discussed later in this disclosure). In an embodiment, the bag (205) will have an attachment hole or insertion point such that the bag (205) can be attached to a ring, hook or other point of attachment and can be more easily transported.

Figure 4:
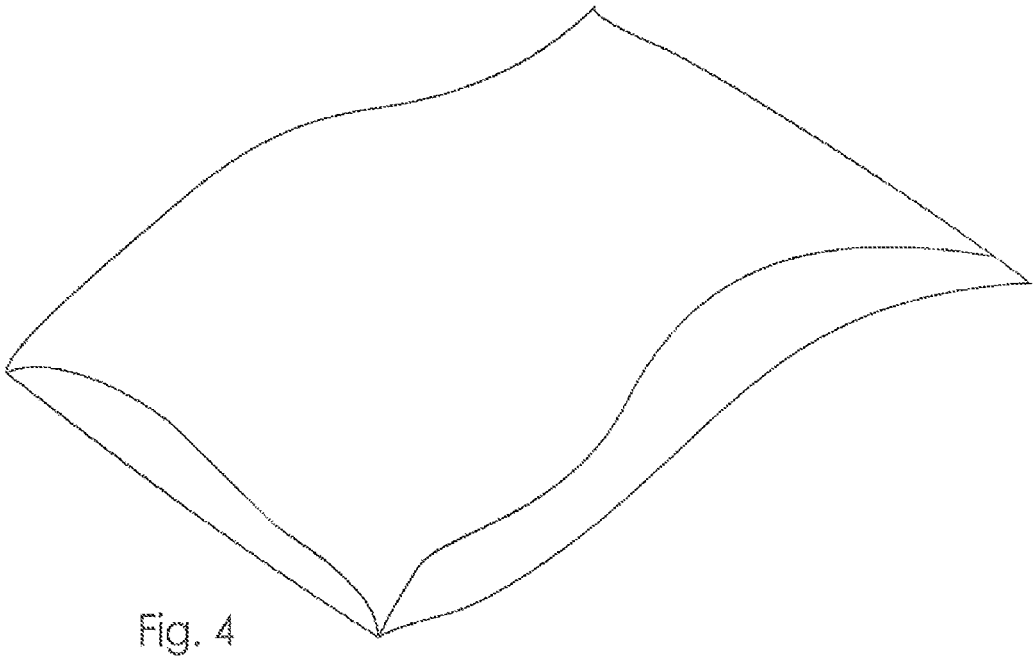
FIG. 4 provides a perspective view of an embodiment of a bag of water.

An embodiment of the bag (205) is illustrated in FIG. 4. While the bag (205) of FIG. 4 is generally in a rectangular shape, such shape is not determinative and any shape known to one skilled in the art is contemplated in this disclosure. Further, the carrying capacity of the bag (205) is not determinative, as this application contemplates any size bag (205) that proves practical for a given situation in which a portable water source is desirable. However, it is preferred that the bag (205) hold around 3 gallons of water to provide for relatively easy transport by hand, while still supplying a reasonable volume.

The components of the system for dispensing potable water disclosed herein (i.e., the ribbed spiked fluid dispensing device (200) and the bagged fluid (205)) interact together in a water dispensing system in the following manner. First, the spiked tip (105) terminus end of the ribbed spiked fluid dispensing device (200) is pushed into the outer wall of the bag (205) with sufficient force such that the ribbed spiked fluid dispensing device (200) penetrates the outer wall of the bag (205), granting the ribbed spiked fluid dispensing device (200) access to the fluid inside the bag (205). It is contemplated that this "spiking force" can come from a user thrusting the ribbed spiked fluid dispensing device (200) or the weight of the fluid filled bag (205) itself, among many other sources.

Once the bag of water (205) is punctured by the ribbed spiked fluid dispensing device (200), the perforated portion of the bag (205) forms a seal around the shaft (102) of the ribbed fluid dispensing device (200) such that there is generally no leakage or seepage of any significant amount in the connection from the fluid housed in the bag (205) to the ribbed spiked fluid dispensing device (200). Sealing of the bag of water (205) about the shaft (102) of the ribbed spiked fluid dispensing device (200) is accomplished when the shaft (102) is sized and shaped so that as the wall of the bag of water (205) is deformed and broken by the spiked tip (105) of the ribbed spiked fluid dispensing device (200), the integrity of the wall of the bag of water (205) remains intact around the entire circumference of the shaft (102) of the ribbed spiked fluid dispensing device (200). Generally, the integrity of the wall of the bag of water (205) remains intact around the shaft (102) of the ribbed spiked fluid dispensing device (200), as well as for some length along the shaft (102) in a direction generally perpendicular to the circumference thereof. In an embodiment, the physical properties of the bag material (e.g., elasticity) promote sealing of the bag material (301) about the shaft (102). The seal is so tight that, even when a large amount of pressure is applied to the bag (205), the ribbed spiked dispensing device (200) stays in place in the bag (205). Stronger force than that able to be applied by human arms has not been able to destabilize an inserted ribbed fluid dispersion device (200) in trial runs.

Once inserted, the ribs (305) along the shaft (102) of the ribbed spiked fluid dispensing device (200) function in two key ways. First, the ribs (305) act as secondary resistance devices making it harder for the spiked fluid dispensing device (200), once inserted into the bagged fluid (205), to be removed. In application, the ribs (305) generally act as a secondary resistance device as follows. As described previously, once inserted into the bag (205), the wall of the bag (205) tightly seals around the shaft (102) of the spiked dispensing device (200). Due to the physical forces of compression and pressure, the ribbed spiked fluid dispensing device (200) stays in place in the bag (205), even when a large amount of pressure is applied to the bag (205). However, there is still a possibility that the fore (23) end of the shaft (102) can be yanked out by a human user or by other forces commonly incurred during fluid transportation. The ribs (305) on the present device anticipate and preclude this possibility. By creating undulations along the length of the shaft (102), the ribs (305) act as a friction/obstruction lock, inhibiting the inadvertent removal of the fluid dispensing device (200) by a user. In addition to functioning as a secondary resistance device, the ribs (305) generally function to allow for a tighter and more secure seal between the bag (205) and the fluid dispensing device (200), further minimizing the risk of seepage of fluid post insertion. Thus, the ribs (305) function to make the dispensing device basically "fool-proof," i.e., once inserted, the ribs (305) act as a resistance device such that the risk of inadvertently removing the dispensing device (200) post insertion, and thereby losing all the water stored in the bag (205) through the resultant unlocked dispersion hole, is greatly reduced if not eliminated. This is important because during emergency water situations, whether in a domestic or a foreign environment, many individuals, under the mental compromising factors of stress, fatigue, and necessity, will be clamoring and grasping for water from the fluid dispensing device (200). Without the added resistance of the ribs (305), it is possible in this environment for these individuals to rip the dispensing device (200) out of the bag (205). Furthermore, even in non-emergency situations where the bagged water dispersion system is utilized, such as at sporting events when athletes are all attempting to get a drink of water at half-time, the added stability of the ribbed fluid dispensing device (200) is an advantage. In addition, the tighter and more secure seal between the bag of water (205) and the ribbed spike (200) is advantageous in any liquid transport, storage and dispersion system known to those of skill in the art that utilizes bagged water including, but not limited to, refrigerator coolers, sideline coolers, domestic coolers, and emergency water transportation and storage devices.

As noted previously in this disclosure, the ribbed spiked fluid dispersion (200) device described herein, and illustrated in FIGS. 1-3, can function in a variety of systems for dispensing of fluids known to those of skill in the art.

Figure 5:
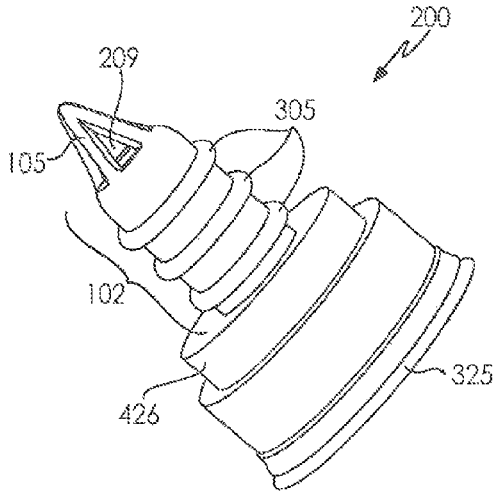
FIG. 5 provides a top perspective view of an embodiment of a ribbed spike.

In one embodiment, the ribbed spiked fluid dispensing device (200) is used in an emergency water dispersion system such as the system described in U.S. Provisional App. No. 119/1685P(1), the disclosure of which is hereby incorporated by reference. In this embodiment, as illustrated in FIG. 5, the ribbed spiked fluid dispensing device (200) has generally two additional components: a base (426) and a rubber cover (325). The base (426) of the ribbed spiked fluid dispensing device (200) is generally located at the fore (23) end of the ribbed spiked fluid dispensing device (200). Like the shaft (102), the base (426) has an interior volume. As depicted in FIG. 5, generally the base (426) has a larger diameter than the shaft (102). Attached to the base (426) is a rubber cover (325) that, once attached, forms a tight seal with the base (426) of the ribbed spiked fluid dispensing device (200). The rubber cover (325) has a knob on the exterior parallel to the spiked tip (105) that, when pushed upward, opens a dispensing slot from which fluid can flow.

Generally, the ribbed spiked fluid dispensing device (200), when utilized in an emergency water dispersion system, functions as follows. First, a user would grasp the ribbed spiked fluid dispensing device (200), with the rubber cover (325) attached, with one hand, and the bag (205) with the other hand. Then the user thrusts the spiked tip (105) terminus end of the ribbed spiked fluid dispensing device (200) into the bag (205), preferably at the terminus end of the bag (205), thereby breaking the bag (205) at the point of insertion. Then a user pushes the rubber cover (426) terminus end of the ribbed spiked fluid dispensing device (200) such that the ribbed shaft (102) would be forced into the interior of the bag (205), and the surface area of the exterior plastic cover of the bag (205) would come into direct contact with the surface area of the base (426) of the ribbed spiked fluid dispensing device (200). Once inserted, the bag (205) forms a seal around the shaft (102) as described in more detail supra. Further, once inserted, the ribbed spiked fluid dispensing device (200) can be used to access the water or other liquid housed inside the bag (205) by adding pressure to push the knob (250) in an upward motion/direction so that a dispensing slot (404) is opened.

In another embodiment, the ribbed spiked fluid dispensing device (200) is used in a self-contained dispenser adapted to hold and dispense bagged fluids such as the system described in U.S. Pat. No. 7,188,749 the entire disclosure of which is hereby incorporated by reference. In this embodiment, a container (100) is used with the bagged fluid (205) to create a water dispensing apparatus. Generally the container (100) used in this apparatus is of a parallelepiped design, though any shape may be used, and includes a hollow interior for placement of the bagged fluid (205). A parallelepiped shaped container (100) is preferred for several reasons, including that a container (100) so shaped generally has a usable volume comprising more of its hollow interior than do many other shapes, the container will not roll or tip easily, and portions of the container (100) do not unnecessarily overhang the surface supporting the container (100) so as to increase the container's (100) effective footprint.

Figure 6:
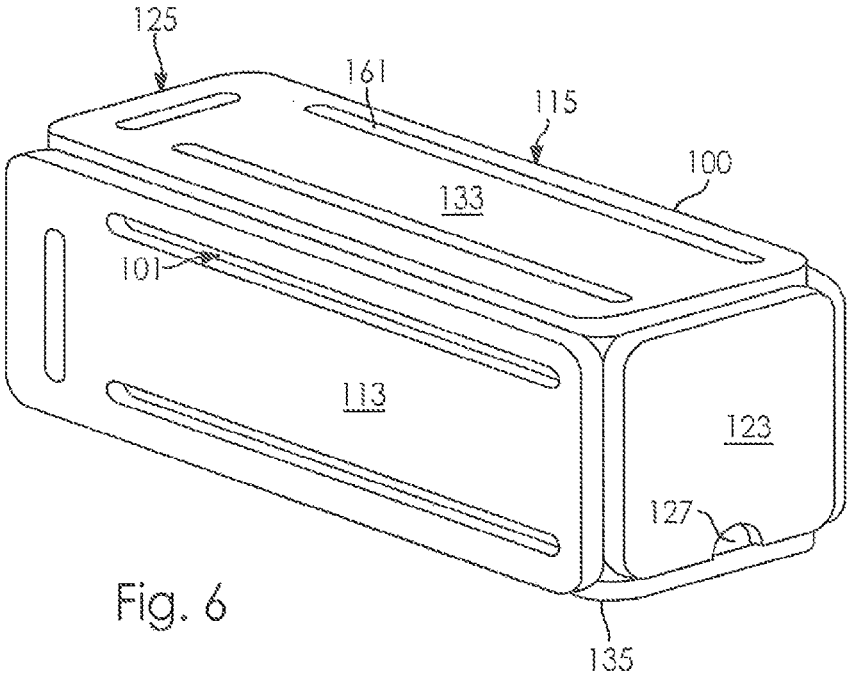
FIG. 6 provides a side perspective view of an embodiment of a container.
Figure 7:
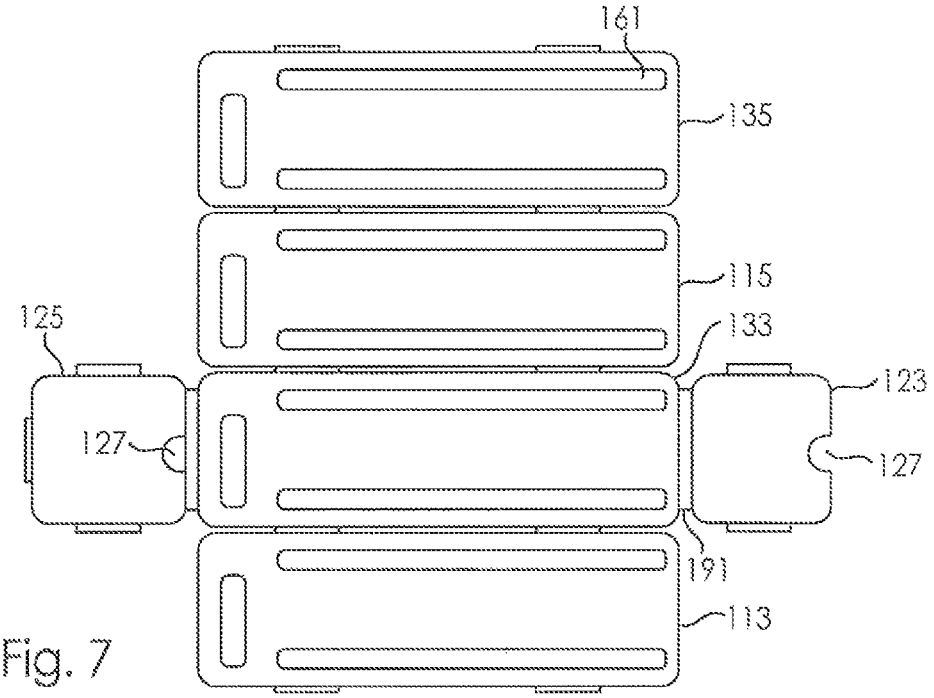
FIG. 7 provides a top perspective view of an embodiment of a container prior to assembly.

An embodiment of a container (100) used in this apparatus is shown in FIGS. 6 and 7. In this embodiment, the container comprises six panels that generally constitute the six sides of a parallelepiped box: two sides (113) and (115), two ends (123) and (125), a top (133) and a bottom (135). On one end (123) there will be an aperture (127) through which the ribbed spiked fluid dispensing device (200) can pass. The container (100) has an inner volume (101) that is created by the six panels of the container (100). While a container (100) with six panels is illustrated in the Figures, this is by no means required and, in alternative embodiments, one or more of the top (133) bottom (135), end (123) and (125) and sides (113) and (115) may be eliminated to provide a container (100) having less than six panels.

Generally, the container (100) shown in FIGS. 6 and 7 will be of a rigid or semi-rigid construction with sufficient strength to resist deformation by the placement of the bagged fluid (205) within the container (100). Thus, the container (100) will often be comprised of wood, plastic, metal, glass, reinforced cardboard, or other similarly supportive materials. Other materials, including laminates and composites, are also usable for construction of an embodiment of the container (100). In another embodiment, the material itself may not necessarily provide the strength required to resist deformation, but the container (100) instead may be assembled so as to provide sufficient strength to resist excessive deformation through principles of engineering well known to those of skill in the art, including the use of a rigid frame covered with a flexible material. It is also contemplated that the container (100) of FIG. 7 may be formed from a cut-out that is bent, adhered or attached to itself to create a parallelepiped container or it may be manufactured originally as a parallelepiped. In alternative embodiments, it is also contemplated that the container (100) has certain features, such as a sloping support or air holes and vents, among other features, that aid in the dispensing of fluid.

Figure 8:
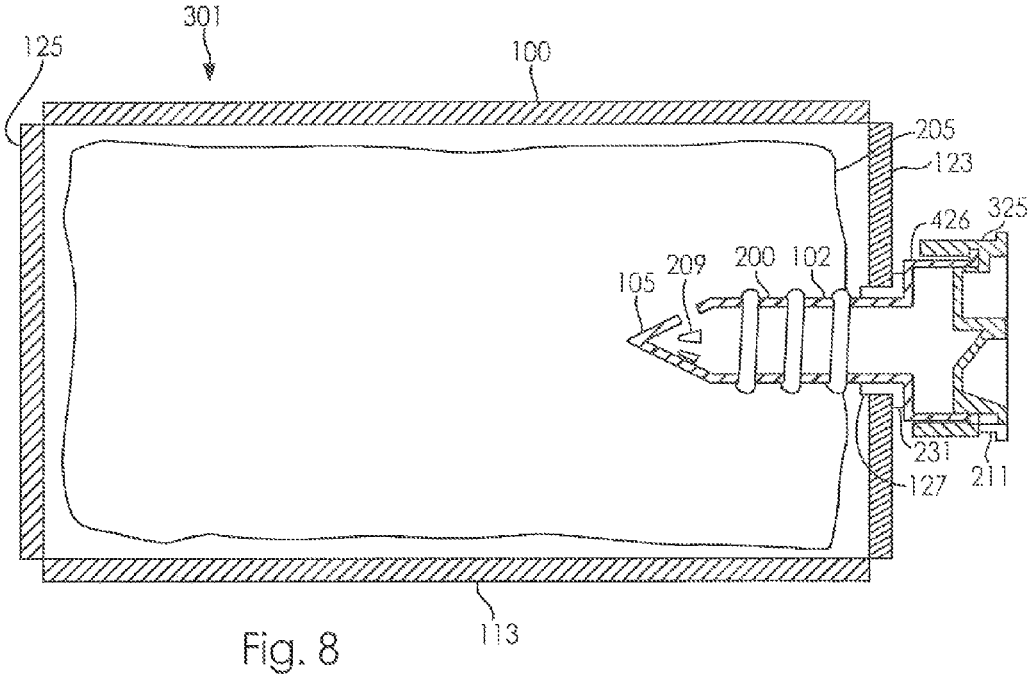
FIG. 8 provides a cross sectional side view of an embodiment of a self-contained fluid dispenser.

In each of the aforementioned container embodiments, the containers (100) are designed to be used in combination with bagged fluid (205) so as to provide a fluid dispensing apparatus. The fluid filled bag (205) is generally used in conjunction with the container (100) as follows. In one embodiment of the dispensing apparatus, the bagged fluid (205) is positioned in the internal volume (101) of the container (100) and enclosed thereby. Once positioned in the container (100), the bag (205) may be adhered to the container (100) for any reason such as providing added support and stability to the bag (205), but is preferably not so adhered to the container (100). A user then inserts the ribbed spiked fluid dispensing device (200) through the aperture (127) in the container (100) and through the outer wall of the bagged fluid (205), both connecting the ribbed spiked fluid dispensing device (200) with the container (100) and puncturing the bag (205) in essentially the same motion. The result of the puncturing of the bag (205) with the ribbed spiked fluid dispensing device (200) in the container (100) is depicted in FIG. 8. In alternative embodiments, the puncturing of the bag (205) occurs while the bag (205) is being placed in the container (100) as a direct result of such placement, or prior to the bag (205) being placed into the container (100).

FIG. 8 shows a cross-sectional view of an assembled self-contained dispensing apparatus for bagged fluids (301) comprising the container (100), the fluid-filled bag (205) and the ribbed spiked fluid dispensing device (200). As illustrated in FIG. 8, the ribbed spike (200) is positioned through the aperture (127) in the front end (123) of the container (100) and penetrates through the wall of the bag (205). By penetrating the bag (205), the ribbed spike (200) allows for the dispensing of the fluid held in the bag (205), as discussed more fully previously in this application. In an embodiment, in order to improve the connection of the ribbed spike (200) to the container (100) and potentially to improve the appearance of the resultant combination, the ribbed spike (200) includes a collar (231) designed to interface with the aperture (127) as shown in FIG. 8. This collar (231) allows the ribbed spike (200) to be held by the end (123) of the container (100) in a predetermined position relative to the container (100) and the bag (205). In this embodiment, the collar (231) provides reinforcement and stabilization to the spike (201), especially during dispensing.

The process of penetrating the bag (205) with the ribbed spike (200) may take many forms depending on the embodiment of the dispensing apparatus. In an embodiment such as just described, the ribbed spike (200) is hand-driven into the bag (205) while the bag (205) is in the container (100). In an alternate embodiment, the inertia of the fluid-filled bag (200) is sufficient to allow spiking of the bag (200).

In an alternative embodiment, in which the ribbed spike (200) projects upwardly into the container (100), the weight of the fluid in the bag (205) is used to push the outer wall of the bag (205) onto the ribbed spike (200) that is already attached to the container (100). In such an embodiment, the combined weight of the bag (205) and the fluid in the bag (205) supplies sufficient force that the spike (200) penetrates the outer wall of the bag (205), connecting the spike (200) directly to the fluid inside the bag (205).

In yet another embodiment, the end (123) is attached to the container (100) at a hinge that includes a spring or similar biasing device that tends to rotate the end (123) from a flat position to an upright position. With this embodiment, the user can place the bag (205) in the container (100), mount the ribbed spike (200) in the aperture (127) in the end (123) while the end (123) is being held in a flat or otherwise open position, and then release the end (123) to rotate under the force of the biasing mechanism into an upright position, causing the mounted ribbed spike (200) to penetrate the enclosed bag (205).

In still another embodiment, the ribbed spike (200) and bag (205) combination may work with an extension screw, piston, bladder or similar drive mechanism that can create a force that pushes the bag (205) against the ribbed spike (200), whether the mechanism works on the bag (205) or the ribbed spike (200) or both. In one such embodiment, the bag (205) is placed in the container (100) and the ribbed spike (200) is positioned in the aperture (127) in the end (123) which end (123) is then brought into the parallelepiped arrangement of FIG. 6 without the bag being penetrated by the ribbed spike (200). A force is then generated against the end (125) of the container (100) in the direction of the ribbed spike (200) using a crank, a screw, a spring, a bladder, or a person's hands. In this embodiment, the end (125) is free to move relative to the rest of the container (100), such that the force on the end (125) is applied to the bag (205) positioned in the internal volume (101), forcing the bagged fluid (205) against the ribbed spike (200), which is held stationary on the end (123) relative to the rest of the container (100). This results in the bag (205) and the ribbed spike (200) being pushed together, and ultimately the penetration of the bag (205). Many arrangements of such a drive mechanism can be engineered to force the bag (205) and the ribbed spike (200) together, as would be understood by one of ordinary skill in the art.

Once inserted into the bag (205) in the container (100), a dispensing mechanism, such as a spigot (211) or other dispensing valve, such as one comprised by a pump, will generally control the dispensing of fluid from the bag (205). The dispensing mechanism generally will be disposed exterior to the container (100), preferably near to the exterior wall thereof. The dispensing mechanism may have any valve design convenient for dispensing fluid on demand. In an embodiment, the spigot (211) is a simple button or lever operated valve that defaults to a closed position (through the use of a spring or other biasing mechanism), and is opened only when the button or lever is moved against the biasing mechanism.

Figure 9:
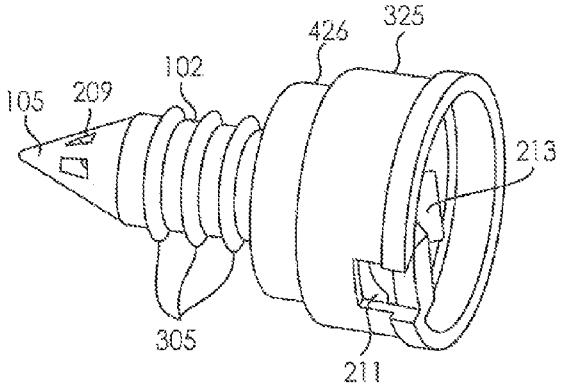
FIG. 9 provides a side perspective view of the ribbed spike fluid dispenser for use in self-contained fluid dispensers.

Shown in a perspective view in FIG. 9, and in a cross-sectional view in FIG. 8, is an embodiment of a spigot (211) that is an embodiment of a dispensing mechanism for a dispensing apparatus described herein. As shown in the Figures, the spigot (211) is part of the rubber cover (325) attached to a ribbed spike (200). In this embodiment, the spigot (211) is a valve made of deformable material such as rubber, and may be formed of any suitable material, including silicone. The rubber cover (325) is connected to the ribbed spike (200) by a snap-like connection, the two elements fitting snugly together as shown in FIG. 9, their surfaces resting against one another to close the path through which the fluid is dispensed. When force is applied on the lever portion (213), a portion of the spigot (211) is thereby separated from contact with the ribbed spike (200), thus allowing dispensing of fluid through the ribbed spike (200) and out the opening between the spigot (211) and the ribbed spike (200) created by the deformation of the rubber cover (325) caused by the force exerted on the lever (213).

In another embodiment, the ribbed spiked fluid dispensing device (200) is used in a portable "Gatorade"® sideline cooler that is adapted to hold and dispense bagged fluids, such as the device disclosed in U.S. Pat. No. 7,165,700. The ribbed spiked fluid dispensing device (200) generally works in conjunction with the portable sideline cooler as follows.

Figure 10:
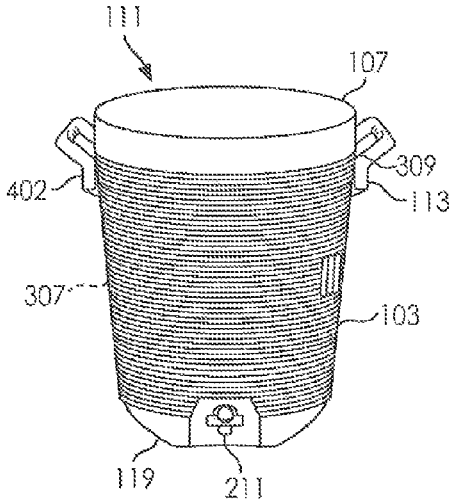
FIG. 10 provides a perspective view of an embodiment of the portable water cooler.
Figure 11:
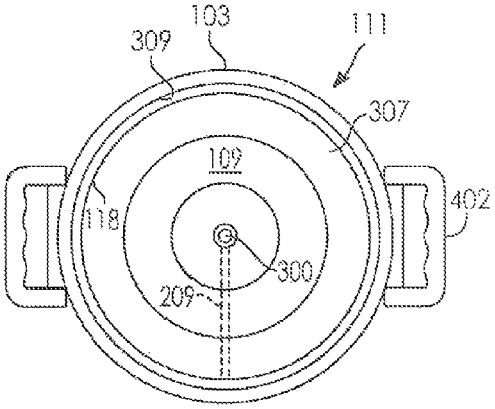
FIG. 11 provides a top perspective view of the interior of an embodiment of a portable water cooler.

One embodiment of a portable water cooler (111) is shown in FIGS. 10 and 11. The portable water cooler (111) of FIGS. 10 and 11 generally comprises a hollow body (103) that defines an internal volume (307) that may be used to contain a fluid. In the illustrated embodiment, the interior of the hollow body (103) has a bottom end (109) and side walls (118), which in combination form the boundaries of the internal volume (307). Generally, the hollow body (103) is in the shape of an upright cylinder having a closed bottom face (119). The hollow body (103) depicted is generally constructed of a durable and fairly rigid material, such as a plastic material, and may be constructed of several layers, including a foam layer or a vacuum layer for insulation. The portable water cooler (111) has a lid (107) used to enclose the internal volume (307). Additionally, the depicted water cooler (111) has a fluid flow pathway (300) that comprises a ribbed spike (200), an enclosed channel (209), and a spigot (211) through which fluid contained in the internal volume (307) can be dispensed. The portable water cooler (111) preferably will serve as a temperature insulator for substances placed inside the hollow body (103).

In the embodiment depicted in FIGS. 10 and 11, there is included on the exterior surface of the portable water cooler (111) at least one handle (402). A handle (402) is an optional component but may be supplied to help with movement of the portable water cooler (111). Shown in FIG. 10 are two handles (113), but that number is by no means required. In further embodiments, a handle (113) may be located anywhere on the external surface, and may be repeatedly removable or moveable between different positions to facilitate transport.

As shown in FIG. 10, the internal volume (307) of the portable water cooler (111) is enclosed by a lid (107) that is designed to be removeably positioned at the upper end (309) of the hollow body (103). The lid (107) may rest on the upper end (309) of the hollow body (103) or may be attached to the hollow body (103) by any type of connection, such as screw threads, a compression ring, or any other connecting method. In another embodiment, the two pieces are simply shaped so as to fit tightly together by friction when compressed together. Generally, when the lid (107) is removed, the internal volume (307) is easily accessible. When the lid (107) is in place at the upper end (309) of the hollow body (103), the internal volume (307) is preferably separated from the ambient environment exterior to the portable water cooler (111), as is any substance within the internal volume (307).

Figure 12:
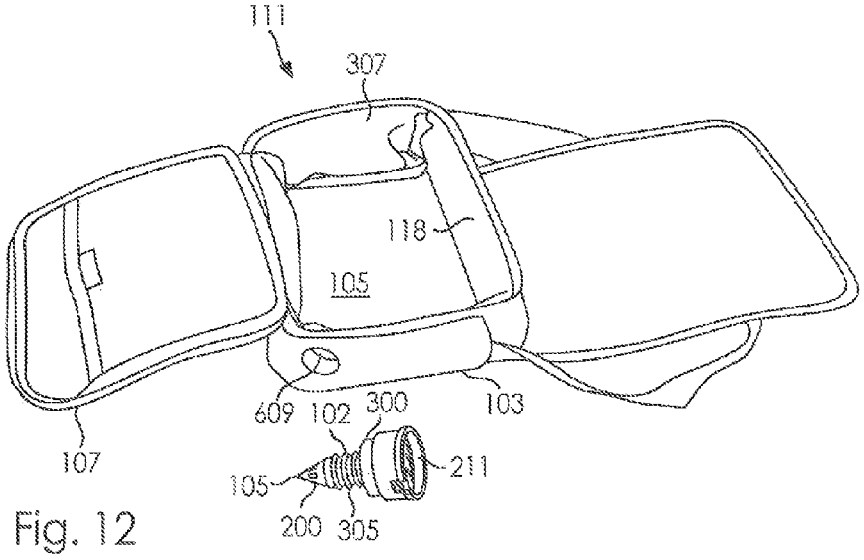
FIG. 12 provides a perspective view of an embodiment of an soft-sided portable cooler.

In alternate embodiments, it is contemplated that the portable water cooler (111) is constructed of generally flexible or pliable materials. While "coolers" constructed of flexible materials are commonly known, they are generally not known to be used to hold fluids. FIG. 12 shows an embodiment of a portable water cooler (111) constructed of generally flexible or pliable materials. The portable water cooler (111) generally comprises a hollow body (103) that defines an internal volume (307) that may be used to contain a bagged fluid (205). In the depicted embodiment, the interior of the hollow body (103) has a bottom end (105) and side walls (118), which in combination form the boundaries of an internal volume (307). In this embodiment, the hollow body (103) is generally in the shape of a parallelepiped, however, this shape is not determinative. Alternative embodiments may use cylindrical designs or designs having other shapes that define an internal volume (307) that may be used to contain bagged fluid.

On the outside of the portable water cooler (111) embodiment of FIGS. 10 and 11 there is made accessible a spigot, which allows for dispensing of the fluid contained within the portable water cooler (111). The spigot (211) may be of any valve design convenient for dispensing fluid on demand, but will generally be a simple push button type valve that defaults to a closed position (through use of a spring or similar biasing mechanism), and is opened only when a push button is depressed.

Figure 13:
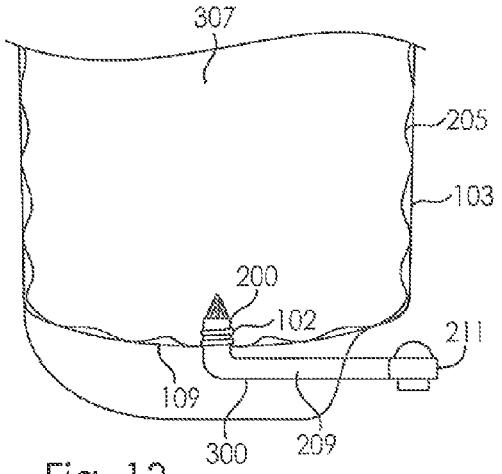
FIG. 13 provides a cross sectional side view of an embodiment of a portable water cooler.

FIGS. 11 and 13 provide for views of the internal volume (307) of the embodiment of FIG. 10, and better illustrate the dispensing of liquid in an embodiment as is shown in FIG. 10. In the embodiments shown, to dispense fluid from inside the portable water cooler (111) through the spigot (211), there is a fluid flow pathway (300) that includes a ribbed spike (200) that projects into the internal volume (307) and that is connected to the spigot (211) by an enclosed channel (209). In the depicted embodiment, the ribbed spike (200) is attached to the bottom end (109) of the portable water cooler (111) and extends generally perpendicular into the internal volume (307) from the bottom end (109). The shaft (102) of the ribbed spiked fluid dispensing device (200) is connected to the enclosed channel (209) which in turn connects to the spigot (211), thereby creating an enclosed fluid flow pathway (300) through which fluid can be dispensed from an internal volume (307) out through the spigot (211).

An embodiment of the portable water cooler (111) may be constructed new, wherein, for example, the portable water cooler (111) is manufactured to include as part of its permanent structure a channel (209), spigot (211) and ribbed spike (200), or is manufactured to mate with a specified channel (209), spigot (211), and ribbed spike (200). Alternatively, an embodiment can be constructed by retrofitting an existing cooler to include a fluid flow pathway (300) capable of dispensing bagged fluid (205). Where a cooler is retrofitted, the channel (209) may attach to an already present spigot (211), though in some embodiments none of the fluid flow pathway (300) components will be present prior to the retrofit. Whether constructed new or retrofitted, the fluid flow pathway (300) may be a permanent component of the portable water cooler (111) or may be designed to be removable and replaceable at will, in whole or in part.

Generally, fluid is made available to be dispensed through the fluid flow pathway (300) by placing a fluid filled bag (205) in the internal volume (307). First, the bag (205) is placed in the internal volume (307) of an upright portable water cooler (111), coming to rest on the bottom end (109) thereof. During the act of placing, the weight of the fluid filled bag (205), along with gravity, cause the ribbed spike (200) to be projected into the fluid filled bag (205) by penetrating the outer wall of the bag (205). In an alternative embodiment, the bag (205) can be placed into the internal volume (307) of the portable water cooler (111) and pressed onto the ribbed spike (200) by another method, such as a force exerted through the hands of the user, in order to puncture the bag (205). In the depicted embodiment, when the spigot (211) is closed, the fluid is generally held in the fluid flow pathway (300) by the valve of the spigot (211). When the spigot (211) is opened, as a result of gravity, the fluid flows from the internal volume (307) through the shaft (102), the channel (209) and the spigot (211) as it is dispensed from the portable water cooler (111), generally in a stream that is captured or used by a user. As can be discerned from this description, the fluid flow pathway (300) of the portable water cooler (111) is segregated from the hollow body (103).

In the alternative embodiment of the flexible portable water cooler (111) of FIG. 12, the bag (205) can be placed in the internal volume (307) of the flexible portable water cooler (111) and pressed onto the ribbed spike (200) by another method, such as a force exerted through the hands of a user in order to puncture the bag (205). Such puncturing by forcing the bag (205) onto the ribbed spike (200) could also be achieved by an alternate mechanism shown in FIG. 12. In this mechanism, the bag (205) is placed in the internal volume (307), the lid (107) is closed, and the user then forces a portion of the fluid flow pathway (300), including the ribbed spike (200), through a hole (609) in the hollow body (103) and into the internal volume (307) also penetrating the outer wall of the bag (205), connecting the fluid flow pathway (300) with the portable water cooler (111) and puncturing the bag (205) in essentially the same motion.

Figure 14:
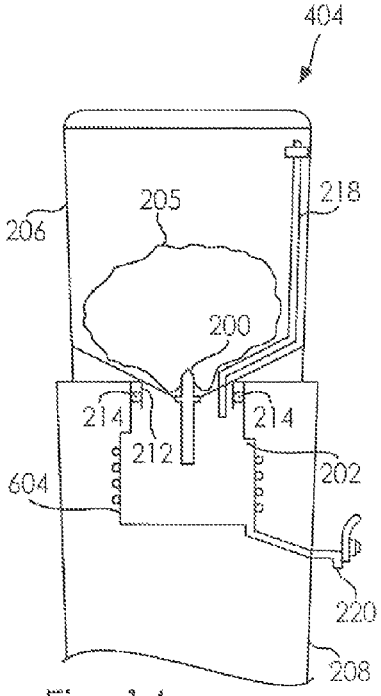
FIG. 14 provides a cross sectional side view of an embodiment of an office cooler.

In still another embodiment, the ribbed spiked fluid dispensing device (200) is used in an office water cooler adapter for bagged fluids, such as the adapter disclosed in U.S. Pat. No. 7,331,487, the entire disclosure of which is hereby incorporated by reference. One embodiment of an office water cooler for bagged fluids (404) in which the ribbed spike (200) will be used is illustrated in FIG. 14. This embodiment comprises an enclosed chamber (202) into which fluid from a fluid-filled bag (205) can flow, and from which fluid can be dispensed from a tap (220). In addition, this embodiment also contains a support (206) which rests on top of the dispensing base and is used to support the bagged fluid (205).

In the embodiment shown in FIG. 14, the support (206) has a collar that extends into the chamber (202). A gasket (214), such as a malleable O-ring, circumscribes and is connected to the collar (212) and fits snugly against the wall of the chamber (202). In an alternate embodiment, the gasket (214) is connected to and generally fixed in place with respect to the chamber (202). In either case, when the support (206) is positioned adjacent to the cooler base (208), the collar extends into the chamber (202) and the gasket (214) fits snugly between the chamber (202) and the collar (212), forming an airtight seal. It should be understood that the purpose of the gasket (214) as shown is to enclose the chamber (202) and that more complex systems can be designed to achieve the same effect. For example, in an embodiment where the chamber (202) is separable from the cooler base (208), both the chamber (202) and the support (206) are sealed with separate gaskets to the cooler base (208).

As shown in FIG. 14, placement of the support (206) onto the cooler base (208) with the collar (212) extending into the cooler base (208) creates an airtight seal between the support (206) and the cooler base (208) as a result of the snug fit created by the gasket (214). Placement of the support (206) and the cooler base (208) as shown in FIG. 14 encloses the chamber (202), and separates the air space of the chamber (202) from the ambient air space external to the support (206) and external to the cooler base (208). Once the chamber (202) is enclosed, fluid (including air or water) communication between the air spaces, i.e., inside and outside the chamber (202), is only possible through the ribbed spike (200) or the vent (218).

Figure 15:
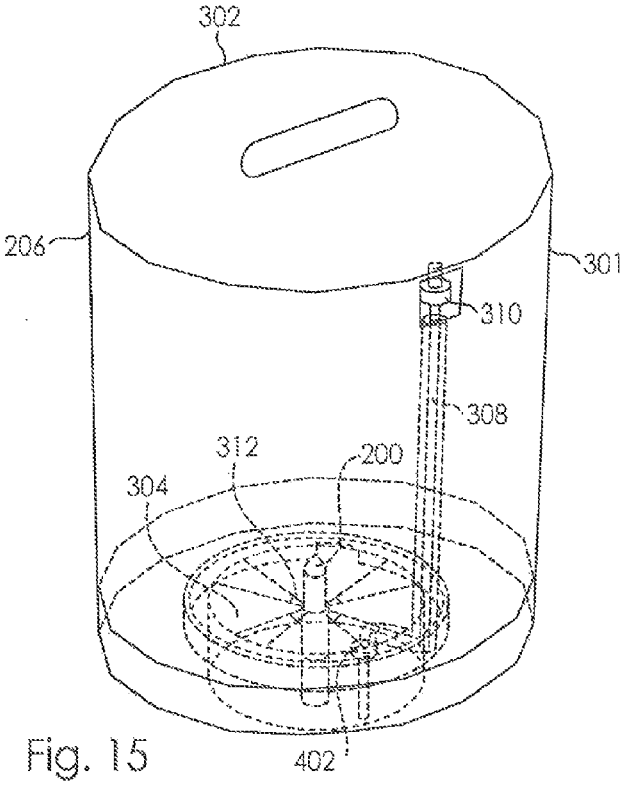
FIG. 15 provides a top perspective interior view of a support for an embodiment of an office cooler.
Figure 16:
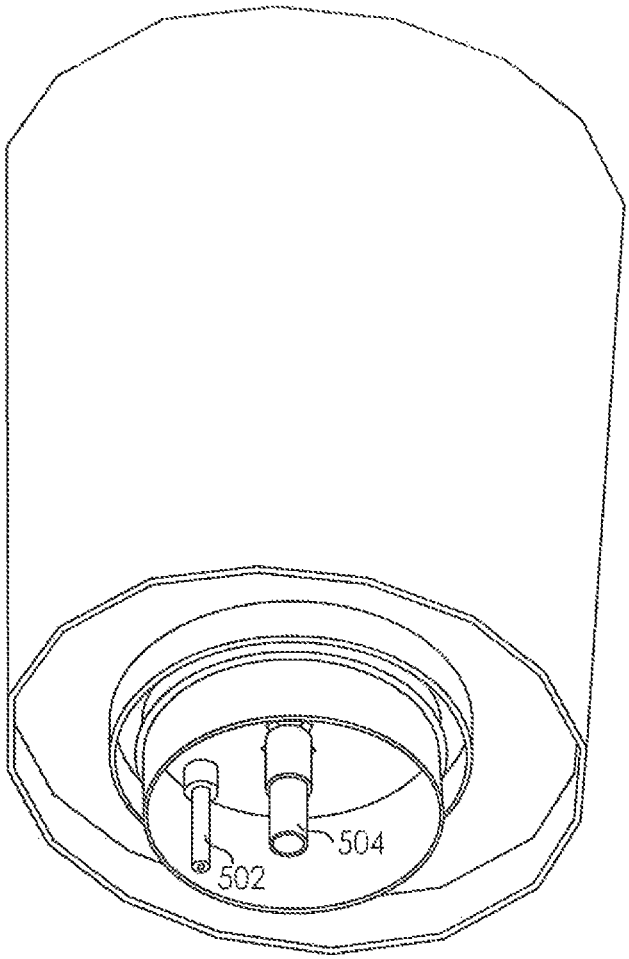
FIG. 16 provides a bottom perspective view of a support for an embodiment of an office cooler.
Figure 17:
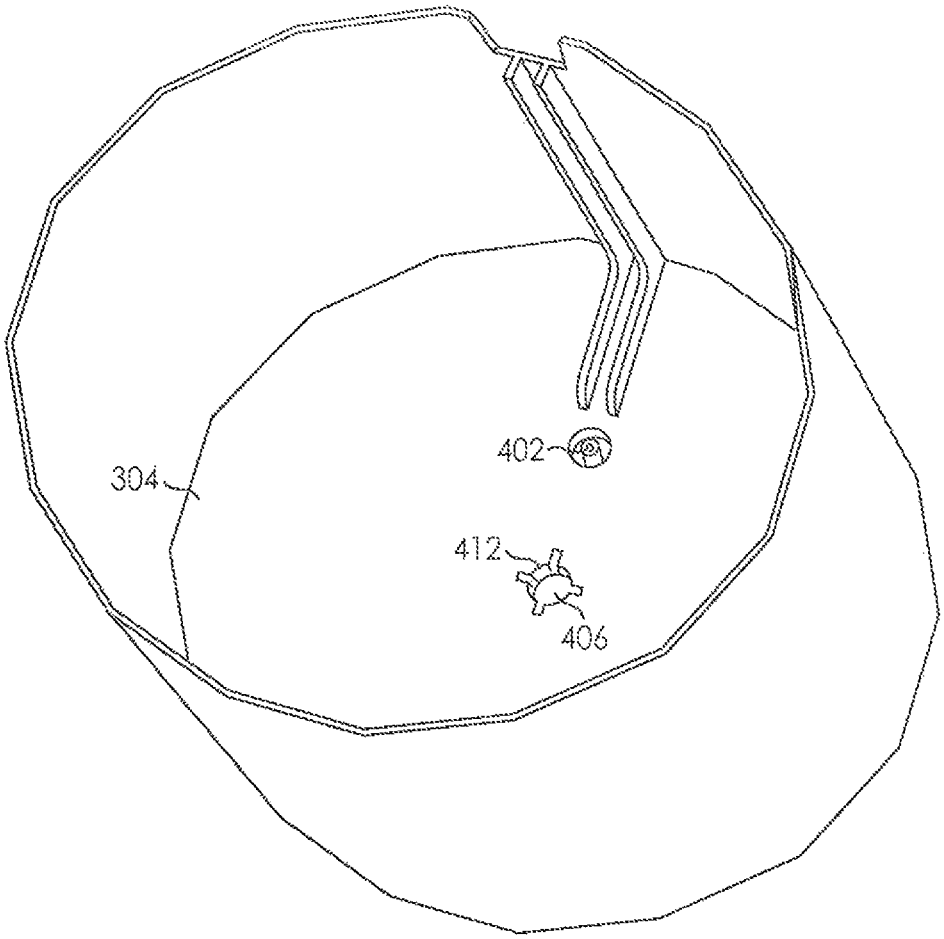
FIG. 17 provides an interior view of a support for an embodiment of an office cooler.

FIGS. 15-17 show various views of an embodiment of the support (206) and various elements connected thereto. This embodiment is generally cylindrical, having upright side walls (301), a removable top cover (302) and a bottom surface (304) that is fixed with respect to the side walls (301) and that slants toward a point that is a local minimum in elevation positioned near the geometric center of the bottom surface (304). As illustrated in FIG. 15, the ribbed spike (200) is positioned at the point of local elevation minimum. In other embodiments, the local minimum need not be near the geometric center of the bottom surface (304). It could be positioned off-center. Further, the support (206) could have more than one local minimum in the bottom surface (304), at each of which is placed a ribbed spike (200). These ribbed spikes (200) may each feed fluid to a single chamber (202) or they may each feed separate chambers (202). It is not necessary, however, that the ribbed spike (200) be positioned at a local elevation minimum, though doing so is preferable as it aids in emptying fluid supported by the support (206).

FIG. 15 shows a vent hole (402) that is connected to a channel traversing from one side to the other of the bottom surface (304) of the support (206). At some position along the length of the vent pipe (308), preferably near its highest elevation as shown here, the vent pipe (308) is attached to a filter (310) that filters any fluid moving through the vent pipe (308) and past the filter (310), and more importantly, fluids moving past the filter (310) and into the vent pipe (308).

As depicted in FIG. 16, a vent extension (502) and spike extension (504) protrude from the bottom side of the support (206). These extension structures (502) and (504) provide extended fluid flow pathways for the vent pipe (308) and the ribbed spike (200), respectively, that extend into the chamber (202) when the support (206) is positioned on the cooler base (208), as shown in FIG. 14.

As shown in FIGS. 14 and 15, and as can be deduced by comparing FIGS. 14 and 15 with FIGS. 16 and 17, in one embodiment, the ribbed spike (200) is securely pressure fit into a hollow (406) at the bottom of the support (206), and is additionally kept from rotating by the interaction of four generally perpendicularly projecting wing flares (312) on the ribbed spike (200) with four slots (412) in the bottom surface (304) of the support (206) adjacent to the hollow (406). The press fit between the ribbed spike (200) and the support (206) is preferably fluid tight. Each wing flare (312) connects to the shaft (102) of the ribbed spike (200) along a length of the circumference thereof that is less than the length of the entire circumference. In alternative embodiments, the ribbed spike (200) may be mated with the support through the use of other methods including the use of threads that screw or bolt the ribbed spike (200) into position. When fit into the hollow (406) in the bottom surface (304), the ribbed spike (200) connects to the spike extension (506), which allows fluids to pass from an internal channel (117) of the ribbed spike (200) to the chamber (202). In one embodiment, the ribbed spike extension (506) is comprised of more than one portion, the portions being repeatably separable so as to enable easy replacement of at least some portions thereof. In another embodiment, the spike extension (506) is a non-separable, molded portion of the support (206). In yet another embodiment, the ribbed spike (200) is long enough that the spike's (200) fluid passage may be a substitute for the spike extension (506).

Fluid is dispensed from the office water cooler adapter by first positioning the bag (205) on the support (206) and having the ribbed spike (200) puncture the bag (205). Upon the puncturing of the bag (205) by the ribbed spike (200), the fluid path out of the chamber (202) through the ribbed spike (200) has become sealed relative to the ambient environment external to the cooler base (208). In other words, after the puncturing of the bag (205), the only connection between the external environment and the chamber (202) is through the vent (218). The vent (218) then becomes the only passage through which to equalize the pressure between the chamber (202) and the external environment. Thus, if fluid flow into or out of the chamber (202) through the vent (218) is appreciably slower than fluid flow into or out of the chamber (202) through either of the ribbed spike (200) or the tap (220), a pressure differential can develop between the chamber (202) and the external environment as fluid enters the chamber (202) from the bag (205) or exits the chamber (202) through the tap (220).

After the bag (205) is punctured by the ribbed spike (200), the force of gravity pulls fluid through the ribbed spike (200) and into the chamber (202), and, assuming the tap (220) remains closed, some air is displaced from the chamber (202). The displaced air preferably travels out of the chamber (202) through the vent (218), since the exit path through the vent (218) represents less resistance to air travel than does a path through the ribbed spike (200) and into the bag (205). As fluid continues to flow from the bag (205) into the chamber (202), the level of fluid contained in the chamber (202) continues to rise, and air continues to be displaced through the vent (218), until the fluid level in the chamber (202) reaches the inlet to the vent (218). Once the fluid level in the chamber (202) reaches the inlet to the vent (218), no more air can be displaced out of the chamber (202). Thus, if the pressure in the chamber (202) is less than the pressure external to the bag (205), as fluid continues to flow into the chamber (202), the pressure in the chamber (202) begins to rise. Fluid flows into the chamber (202) and the pressure in the chamber (202) rises until the point where the pressure in the chamber (202) equals the ambient pressure external to the bag (205). Fluid from the bag (205) will flow into the chamber (202), and fluid from the chamber (202) will be pushed up into the vent (218), only until the fluid height in the vent (218) equals the height of the fluid in the bag (205). At this point, flow from the bag (205) into the chamber (202) will stop.

Now with fluid in the chamber (202), the same fluid can be dispensed through the tap (220). When the tap (220) is opened to allow fluid to be dispensed from the chamber (202), the water level in the chamber (202) decreases, until eventually the fluid level in the chamber (202) is lower than the inlet of the vent (218). During dispensing, the pressure in the chamber (202) is reduced from the value at equilibrium (no flow), thus allowing fluid to begin again to flow from the bag (205) into the chamber (202). So long as the volume fluid flow through the ribbed spike (200) is less than the volume fluid flow through the tap (220), the fluid level in the chamber (202) continues to decrease as the fluid continues to be dispensed. As well, so long as the pressure in the chamber (202) is less than the pressure external to the bag (205), fluid in the vent (218) will be forced back into the chamber (202), until, at some point, all the fluid from the vent (218) will have been forced back into the chamber (202), and air from external to the cooler base (208) will begin to flow into the chamber (202) through the vent (218). Air flow into the chamber (202) through the vent (218) will continue until the pressure in the chamber (202) is equal to the ambient pressure external to the bag (205). So long as the volume rate of flow out of the tap (220) (i.e., out of the chamber (202)) is greater than the combined volume rate of flow into the chamber (202) through the ribbed spike (200) and the vent (218), the pressure in the chamber (202) will continue to decrease.

When the tap (220) is finally closed, the reduced pressure in the chamber (202) will add to the total force working to move fluid from the bag (205) into the chamber (202). Not only will gravity be pulling the fluid through the ribbed spike (200), but also pressure external to the bag (205) will be pushing the fluid through the ribbed spike (200) into the chamber (202). Such a chamber (202) in which pressure is reduced during dispensing is beneficial to the evacuation of fluid from the bag (205) to the greatest extent, since, in effect, the reduced pressure in the chamber (202) results in a greater net force working to push fluid out of the bag (205). As stated above, these forces will work to move fluid from the bag (205) into the chamber (202) (at the same time atmospheric pressure is pushing air into the chamber (202) through the vent (218)) until all forces are equilibrated, wherein the fluid will have risen in the vent (218) to a height equal to the height of the fluid in the bag (205).

The bottom of the vent extension (502) is preferably higher in the chamber (202) than is the bottom of the ribbed spike extension (506). Generally, the lower the height of the inlet to the vent (218) (i.e., the bottom of the vent extension (502)) relative to the bottom of the chamber (202), there is less time for the pressure in the chamber (202) to equilibrate with ambient pressure external to the bag (205) prior to the water level in the chamber (202) reaching the inlet to the vent (218). If the volume fluid flow into the chamber (202) through the ribbed spike (200) is greater than the combined volume fluid flow out of the chamber (202) through both the tap (220) and the vent (218), there will be an increase in pressure in the chamber (202), which can increase above the pressure external to the bag (205). An increase in pressure is more likely to happen with a longer vent extension (502), since there is less time for the pressure to equilibrate before the fluid level in the chamber (202) reaches the bottom of the vent extension (502). If the pressure in the chamber (202) is greater than the ambient pressure external to the bag (205) when the water level in the chamber (202) reaches the inlet to the vent (218), the fluid in the vent (218) is likely to be pushed up into the vent (218) to a level above the level of the fluid in the bag (205) and, then, may erupt from the top of the vent (218), which is an undesirable event.

In a preferred embodiment the dimensions of the components of the fluid dispensing system (404), particularly those of the chamber (202), the fluid passage (604) of the ribbed spike (200) and ribbed spike extension (506), and the vent (218) and vent extension (502), are such that while a pressure reduced below the pressure external to the bag (205) may form in the chamber (202) during dispensing, no increase in pressure above the pressure external to the bag (205) will form while the chamber (202) is being refilled from the bag (205).

Additionally, in a preferred embodiment, the dimensions of the components of the fluid dispensing system (404), particularly those of the chamber (202), the fluid passage (604), of the ribbed spike (200) and ribbed spike extension (506), and the vent (218) and vent extension (502), are such that there is no piston action that shoots water out of the top of the vent (218) upon the puncturing of the bag (205) with the ribbed spike (200). In a case where a new bag (205) full of fluid is punctured by the ribbed spike (200), it is possible that there will be a transient increase in pressure in the chamber (202), especially if the bag (205) is dropped onto the ribbed spike (200), as in the preferred embodiment discussed above. In the event there is such a transient pressure increase in the chamber (202), it is preferable that the vent channel (218) not have retained fluid, such as may occur when the vent channel (218) is small enough that the fluid surface tension is sufficient to maintain fluid in the vent (218). Additionally, it is preferable that sufficient air remains in the vent channel (218) between any retained fluid and the top of the vent (218) or the filter (310), since this air can act as a cushion to absorb the shock of any transient pressure increase, thereby preventing fluid from being pushed out the top of the vent (218).

As is known to one of ordinary skill in the art, the chamber (202) may be heated or cooled through the use of various methods, and a dispensing system (404) may even comprise more than one chamber (202), in which case, for example, a first chamber (202) can be cooled and a second chamber (202) heated to provide both cooled and heated fluid from the same fluid dispensing system (404).

This fluid dispenser (404) can be fabricated new, or portions thereof can be manufactured to retrofit other existing portions thereof in order to construct a complete embodiment of the present invention. Particularly, a support (206) can be manufactured to fit with an existing cooler base (208) having a chamber (202). Where a support (206) is manufactured to retrofit an existing cooler base (208), the design of the support (206) may take account of and incorporate the use of various components of the existing cooler base (208), or other components of an existing dispensing system attached thereto, such as, for example, any portions designed to isolate the chamber (202) from external environmental influences.

As noted above, since an important function of the support (206) with respect to the bag (205) is merely to support the bag (205) while fluid is being drained from the bag (205), the support (206) may adopt various shapes suitable for accomplishing this function without departing from the scope of the invention. FIGS. 14-17 show an embodiment of the support (206) that is generally cylindrically shaped. Another possible shape is essentially a V-shape, having two, converging, planar sides. Other possible shapes for the support are discussed or shown in Provisional Patent Application No. 60/502,723, filed Sep. 12, 2003, including a single, level plane and a surface in which such a level plane has been uniformly curved along one dimension. In an embodiment, the support (206) includes a cover (302) positioned at the top of the support (206), which cover (302) may provide further protection against contamination of any fluid to be dispensed from the cooler.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A spike for use in dispensing a liquid from a bag, the spike comprising:

a hollow shaft comprising two ends and an elongated body therebetweeen, said body including an outer surface and defining an internal volume;

a cone-shaped tip comprised of a base and a terminating point, said base of said cone-shaped tip connected at a first of said two ends, said cone-shaped tip being capable of penetrating the outer surface of a bag containing fluid;

at least one opening in said cone-shaped tip, said at least one opening allowing access into the interior volume of said hollow shaft; and a plurality of ribs, each of said ribs in said plurality being independently positioned on an external surface of said body so as to circumscribe said body at a point between said two ends.

2. The spike of claim 1 wherein said body is generally cylindrical.

3. The spike of claim 1 further comprising a spigot at a second of said two ends.

4. A liquid dispensing system, the system comprising:

a spike, the spike comprising:

a hollow shaft comprising two ends and an elongated body therebetweeen, said body including an outer surface and defining an internal volume;

a cone-shaped tip comprised of a base and a terminating point, said base of said cone-shaped tip connected at a first of said two ends;

at least one opening in said cone-shaped tip, said at least one opening allowing access into the interior volume of said hollow shaft; and a plurality of ribs, each of said ribs in said plurality being independently positioned on an external surface of said body so as to circumscribe said body at a point between said two ends; and a flexible bag comprising:

an outer wall; and a fluid contained therein said outer wall;

wherein said spike is positioned through said outer wall such that said cone-shaped tip and at least one of said plurality of ribs is within said fluid, at least one of said plurality of ribs is external said outer wall, and said outer wall is sealed about said hollow shaft.

5. A method for dispensing liquid, the method comprising:

providing a spike, the spike comprising:

a hollow shaft comprising two ends and an elongated body therebetweeen, said body including an outer surface and defining an internal volume;

a cone-shaped tip comprised of a base and a terminating point, said base of said cone-shaped tip connected at a first of said two ends;

a spigot arranged at a second of said two ends; and a plurality of ribs, each of said ribs being arranged on an external surface of said body so as to circumscribe said body at a point between said two ends; and providing a flexible bag comprising:

an outer wall; and a fluid contained therein said outer wall;

spiking said bag by forcing said spike through said outer wall such that said tip and at least one of said plurality of ribs is within said fluid and said outer wall is sealed about said hollow shaft; and dispensing said fluid by opening said spigot.

* * * * *